US005924898A

United States Patent [19]

Dutton et al.

[11] Patent Number: 5,924,898

[45] Date of Patent: Jul. 20, 1999

[54] MODULAR CONNECTOR

[75] Inventors: Peter Dutton, Fremont; Mohamad Higgy, Redwood City; Timm Seaton, Fremont, all of Calif.

[73] Assignee: Raychem Corporation, Menlo Park, Calif.

[21] Appl. No.: 08/865,220

[22] Filed: May 29, 1997

[51] Int. Cl.[6] ..... H01R 13/502

[52] U.S. Cl. ..... 439/701

[58] Field of Search ..... 439/607, 608, 439/609, 701, 677, 680, 681, 378, 65

[56] References Cited

U.S. PATENT DOCUMENTS

| | | | |
|---|---|---|---|
| 3,085,221 | 4/1963 | Kelly | 439/681 |
| 3,184,707 | 5/1965 | Anderson | 439/681 |
| 3,671,921 | 6/1972 | Baker, III et al. | 339/59 M |
| 4,619,490 | 10/1986 | Hawkings | 339/31 M |
| 4,659,162 | 4/1987 | Cartesse | 339/128 |
| 4,927,388 | 5/1990 | Gutter | 439/660 |
| 5,125,854 | 6/1992 | Bassler et al. | 439/607 |
| 5,356,300 | 10/1994 | Costello et al. | 439/378 |

*Primary Examiner*—Steven L. Stephan
*Assistant Examiner*—Javaid Nasri
*Attorney, Agent, or Firm*—Sheri M. Novack; Herbert G. Burkard

[57] ABSTRACT

A modular connector includes a set of pairs of modular inserts configured to mate with each other to convey electrical signals or power in a structure such as a vehicle. Each pair of modular inserts are coupled to their respective wiring lines and supported by their respective structures. One of each pair of modular inserts is supported by a receptacle shell, while the other is supported by a plug shell. The modular inserts are characterized with removable characterized buttons for cooperation respectively with characterizations slots provided in the receptacle shell and plug shell. The characterization scheme ensures that incorrect modular inserts are not loaded onto the wrong position of the receptacle shell and plug shell. The shields of the wiring lines are grounded to grounding contacts provided in the corresponding modular inserts. The receptacle shell is coupled to a grounding shell supported by the vehicle with the corresponding grounding contacts contacting the grounding shell for grounding. The plug shell is coupled to the receptacle shell to place the respective contacts in the pairs of modular inserts in mating connections to convey signals or power. The grounding contacts of the modular inserts in the plug shell contact the grounding shell for grounding. The connector is easy and quick to assemble without the need for tools and with savings in assembly time.

28 Claims, 10 Drawing Sheets

SECTION A-A

SECTION B-B

MODULAR CONNECTOR

FIELD OF THE INVENTION

This invention relates generally to connectors for conveying electrical signals or power and, more particularly, to a modular connector that includes replaceable modular inserts which provide quick and easy mating connections with robust adaptability to a wide range of applications and that incorporates a low resistance grounding scheme.

BACKGROUND OF THE INVENTION

Connectors for conveying electrical signals and power are used in a wide variety of applications, including commercial and military vehicles. The design of connectors are particularly complex for large structures such as commercial aircraft because of the large number of electrical wires and cables scattered throughout the structures. The complexity of managing the electrical connections is exacerbated by the requirement for connections of different sizes and arrangements to fit different applications and by the need to ground the large number of wires spread throughout the structure.

The need for different connections requires the use of differently sized contacts and connectors that are arranged in various configurations. To avoid installing the wrong component in a connector, it has been customary to introduce structural distinctions in the mating components of the connectors to ensure that the correct connector component is installed in the correct location. As a result, the number of different connector components that need to be stocked in inventory is multiplied, and may reach beyond a thousand for a large structure such as a commercial aircraft. Such a practice is inefficient and costly from the stand point of manufacturing and storage as well as installation.

Under current practice, it is also costly and inefficient to modify the electrical connections in a structure such as an aircraft, which generally requires cutting out panels to accommodate a different wiring configuration every time a change is to be implemented.

The grounding scheme currently used generally requires indirect grounding through multiple intermediate grounding levels or interfaces for some wires. This is especially common in large structures with substantial wiring spread throughout, and such a practice introduces high resistance to ground. The lack of a robust grounding scheme also necessitates considerable labor time devoted to grounding during the structure or vehicle assembly level. This further increases cost and time to install the electrical connections for the structure.

SUMMARY OF THE INVENTION

There is a need for a more efficient and robust device and method for providing connections to convey electrical signals and power in structures such as vehicles.

It has now been discovered that a more robust connector may be advantageously employed and adapted to a wider range of applications.

It is a feature of this invention to provide a robust connector that is adaptable and reduces the number of different inventory component parts.

It is another feature of the invention to provide a low resistance grounding scheme in a connector.

It is yet another feature of this invention to provide a connector that is easy to use and assemble, and is cost-efficient.

In accordance with one aspect of the present invention, a connector for use in a structure for conveying signals or power comprises a receptacle insert holder having at least one first receptacle characterization slot. At least one receptacle insert has a first set of first removable receptacle characterization buttons. With removal of one of the first removable receptacle characterization buttons, remaining first removable receptacle characterization buttons are insertable through a portion of the at least one first receptacle characterization slot for support of the at least one receptacle insert in the receptacle insert holder in a preset receptacle insert location. The connector further comprises a plug insert holder having at least one first plug characterization slot. At least one plug insert has a first set of first removable plug characterization buttons. With removal of one of the first removable plug characterization buttons, remaining first removable plug characterization buttons are insertable through a portion of the at least one first plug characterization slot for support of the at least one plug insert in the plug insert holder in a preset plug insert location.

In accordance with another aspect of the invention, a device for forming an electrical connection comprises at least one pair of mating inserts. Each pair of mating inserts includes a receptacle insert and a plug insert. The receptacle insert has a plurality of removable receptacle coding buttons and at least one receptacle contact. The plug insert has a plurality of removable plug coding buttons and at least one plug contact engageable with the at least one receptacle contact for mating contact. The at least one receptacle contact and the at least one plug contact are equal in number. The device further comprises a means for supporting the at least one pair of mating inserts in mating contact in coded positions.

Another aspect of this invention is a modular insert for forming mating contact in a structure having a plurality of preset insert locations. The modular insert comprises a contact surface having zero or at least one contact opening and a plurality of removable characterization buttons. By removing one of the plurality of removable characterization buttons, the modular insert is receivable in only one of the plurality of preset insert locations of the structure.

Yet another aspect of the present invention is an adaptable insert for forming mating contact in a structure. The adaptable insert comprises a contact surface having zero or at least one contact opening and at least one aperture for supporting at least one grounding contact. The at least one aperture is set off in a rear direction from the contact surface to support the at least one grounding contact for grounding to the structure.

BRIEF DESCRIPTION OF THE DRAWINGS

The preferred embodiments of this invention, illustrating all their features, will now be discussed in detail. These embodiments depict the novel and nonobvious modular connector of this invention shown in the accompanying drawings, which are included for illustrative purposes only. These drawings include the following figures, with like numerals indicating like parts.

DETAILED DESCRIPTION OF THE INVENTION

Figure 1:
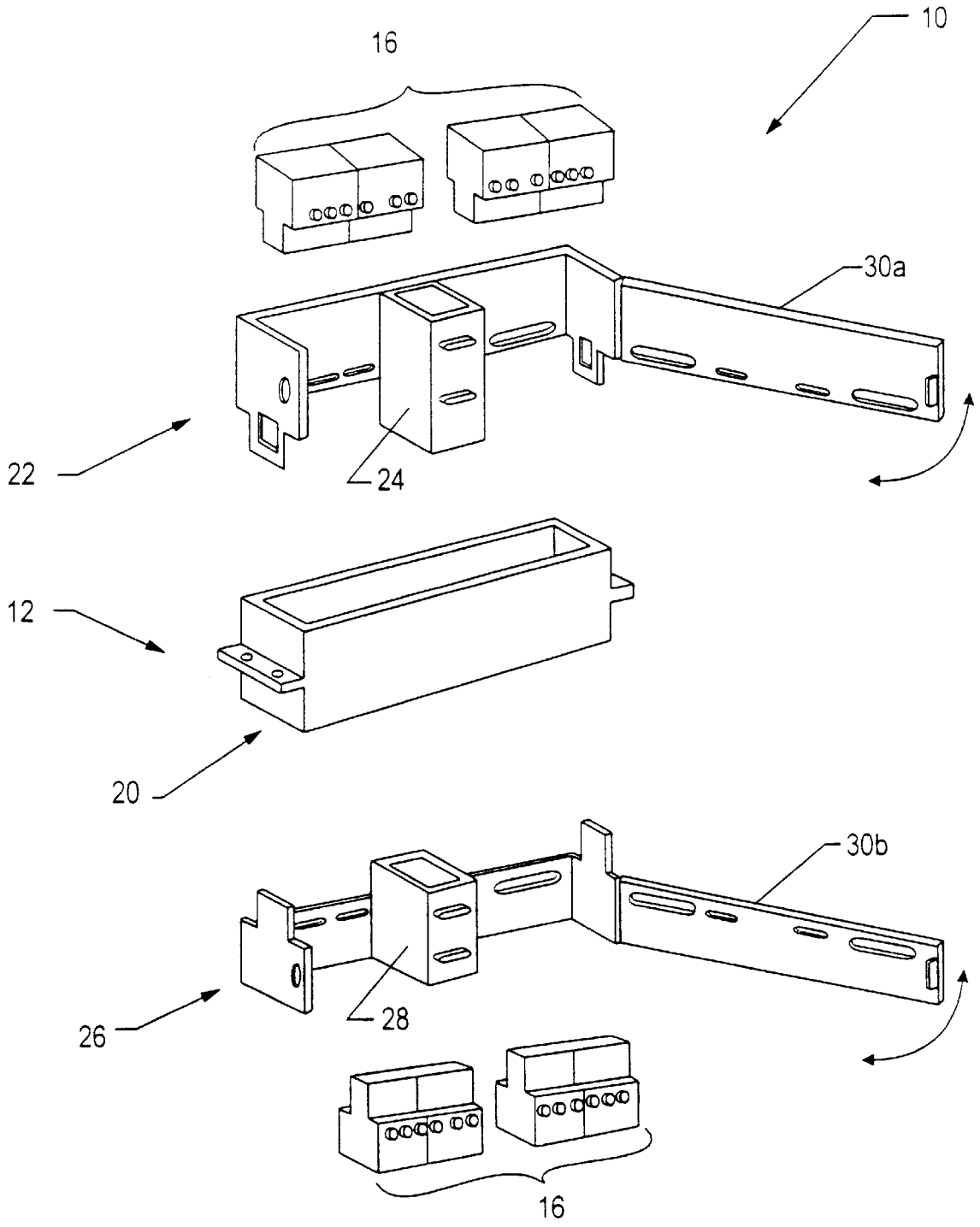
FIG. 1 is an exploded perspective view illustrating an embodiment of a modular connector of the present invention.

Referring to FIG. 1, the connector 10 includes a body 12 that advantageously houses a plurality of connector modules or modular inserts 16 which carry wiring lines or cables (not shown) and mate with each other to provide a connection for conveying electrical signals or power through such lines. The body 12 of FIG. 1 can accommodate four pairs of modular inserts 16 to form four connection zones or regions. It is understood, however, a different number of connection regions may be provided by changing the size or configuration of the body 12, and the number of pairs of modular inserts 16 is not limited to four. Furthermore, although the modular inserts 16 of FIG. 1 are generally rectangular in shape, modular inserts of other shapes may be used in other applications. It is customary to use rectangular inserts 16 to produce a high number of contact cavities for electrical connections, which are generally round but may have any configuration.

The function of the body 12 advantageously is to support the modular inserts 16 with different wiring configurations securely in connection with each other and to ground the shields on the wiring lines or cables (not shown) to the structure or vehicle in which the connector 10 is disposed and functions. FIG. 1 illustrates a body 12 which comprises a grounding member 20, a receptacle member 22, a receptacle spacer 24, a plug member 26, a plug spacer 28, and a pair of doors 30*a*, 30*b*. The door 30*a* is a receptacle door 30*a* for the receptacle member 22 and the other is a plug door 30*b* for the plug member 26, and they may be generally identical if desired for convenience. It is understood that the body 12 of FIG. 1 is merely illustrative and other designs for the body 12 may be used to achieve the specified functions.

A. Grounding Member

Figure 2:
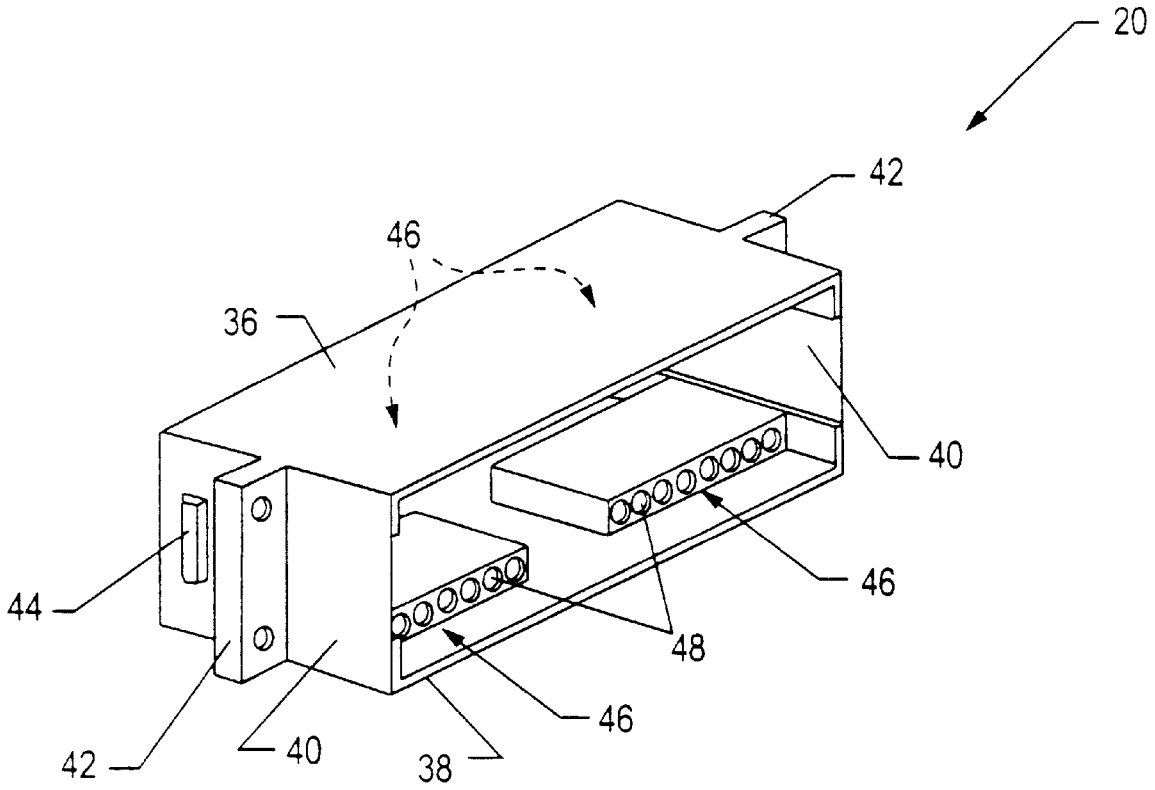
FIG. 2 is a perspective view illustrating the grounding shell of the modular connector of FIG. 1.

Referring to FIG. 2, the grounding member or shell 20 has a shell-like structure with a front panel 36, a back panel 38, and two side panels 40. Extending from the side panels 40 are desirably a pair of grounding wings 42 that connect the grounding shell 20 to the structure such as a vehicle (not shown) in which the connector 10 is disposed for grounding. A pair of tab-like projections 44 are desirably provided on the side panels 40 for use in attaching the receptacle member 22 with the grounding member 20.

The grounding shell 20 has a hollow interior with four grounding sections 46, a pair against the interior surface of the front panel 36 and a pair against the interior surface of the back panel 38. Each pair of the grounding sections 46 are desirably spaced from one another to accommodate the receptacle spacer 24 and plug spacer 28 when assembled. Each grounding section 46 has a plurality of grounding apertures 48 that are at least partially through the width of the grounding section 46. The number of grounding apertures 48 is chosen based on a particular application to accommodate the modular inserts 16 used. In the embodiment shown, there are four grounding apertures 48 per modular insert 16, and each grounding section 46 has eight grounding apertures 48 to accommodate a total of four pairs of modular inserts 16. The first set of grounding apertures 48 facing the receptacle shell 22 in FIG. 1 are configured to receive the receptacle modular inserts 16 supported by the receptacle shell 22. The second set of grounding apertures 48 facing the plug shell 26 in FIG. 1 are configured to receive the modular inserts 16 supported by the plug shell 26. The grounding shell 20 is desirably made of a strong, light-weight, and benign material that is not susceptible to environmental effects such as corrosion. Examples of such materials include stainless steel, desirably of the passivated 300 series type, and certain kinds of aluminum, brass, and copper.

B. Receptacle Member and Spacer

Figure 3A:
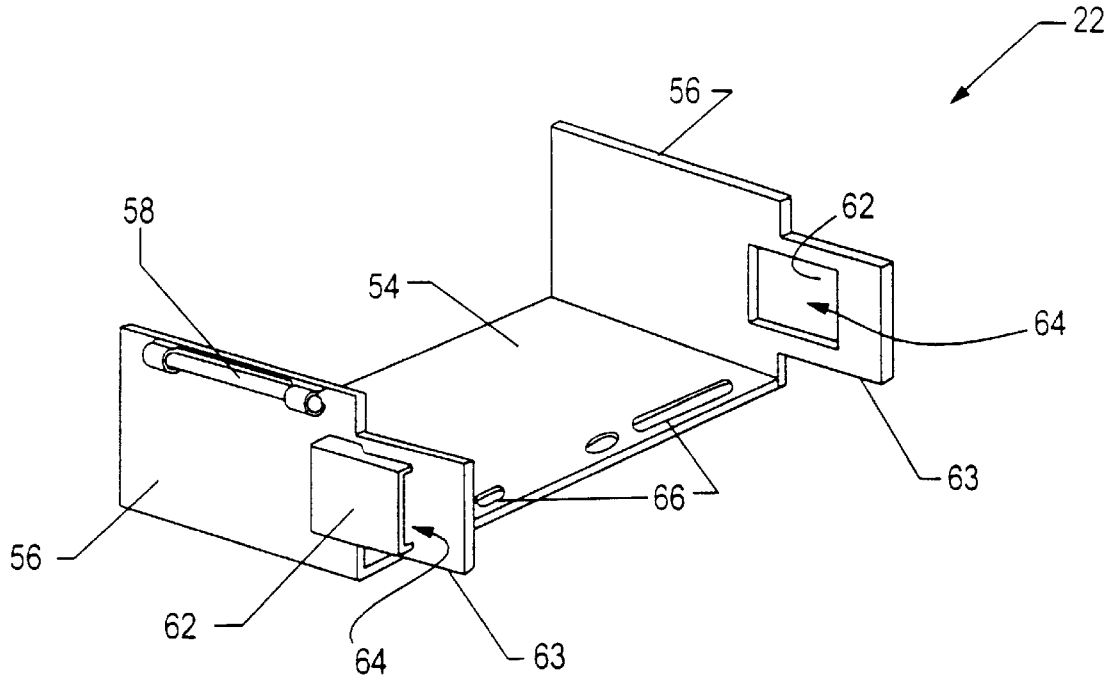
FIG. 3*a* is a perspective view illustrating the receptacle shell of the modular connector of FIG. 1.
Figure 3B:
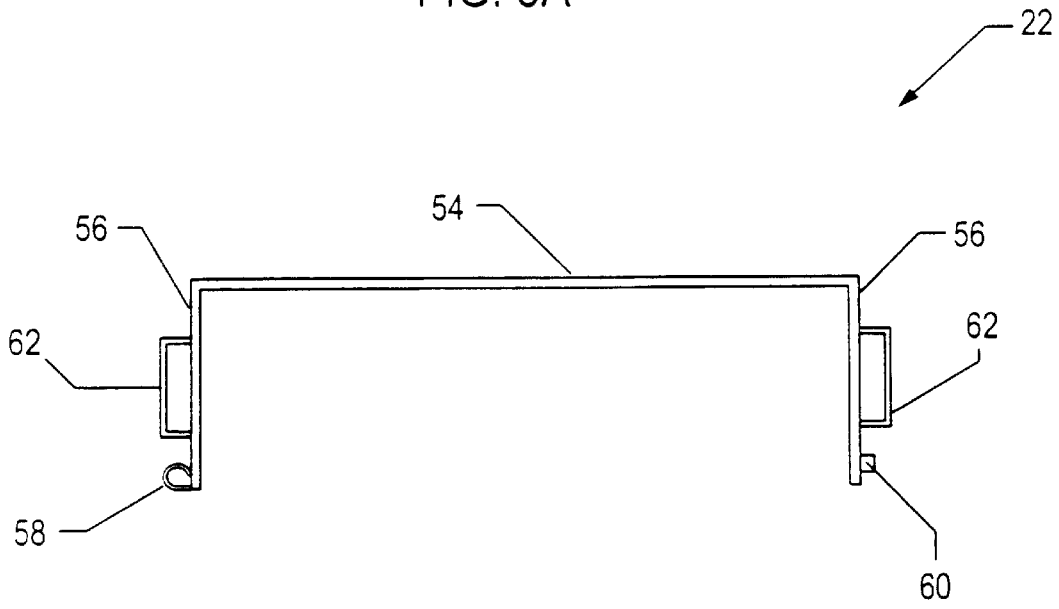
FIG. 3*b* is a bottom plan view of the receptacle shell of FIG. 3*a*.

The receptacle member or shell 22 shown in FIGS. 3*a* and 3*b* is also a shell-like structure with a back panel 54 and two side panels 56. A hinge 58 is provided adjacent the open edge of one of the side panels 56 and a catch 60 extends adjacent the open edge of the other side panel 56 for installation of the receptacle door 30*a* of FIG. 1. When the receptacle door 30*a* is installed, the receptacle shell 22 defines a hollow region that is similar in cross-section to that of the grounding shell 20.

Each side panel 56 has an elongated section 63 that is desirably narrower with a projected plate-like member 62 on the outer surface pointing toward the grounding member 20 and with an opening 64 comparable in size with the projected member 62. When the receptacle shell 22 is assembled with the grounding shell 20, the pair of projected members 62 slide over the tab-like projections 44 to be fastened together using a retaining clip or the like (see FIG. 10*a*). Other means of attaching the receptacle shell 22 with the grounding shell 20 as known in the art may be used as well.

As seen in FIG. 3*a*, the back panel 54 includes a series of slots 66 near its front edge pointing toward the grounding member 20. The slots 66 are coding or characterization slots 66 which determine the selection of the modular inserts 16 to be used for particular coded locations. Different arrangements of coding slots 66 may be used depending on the specific application and characterization scheme.

Figure 4A:
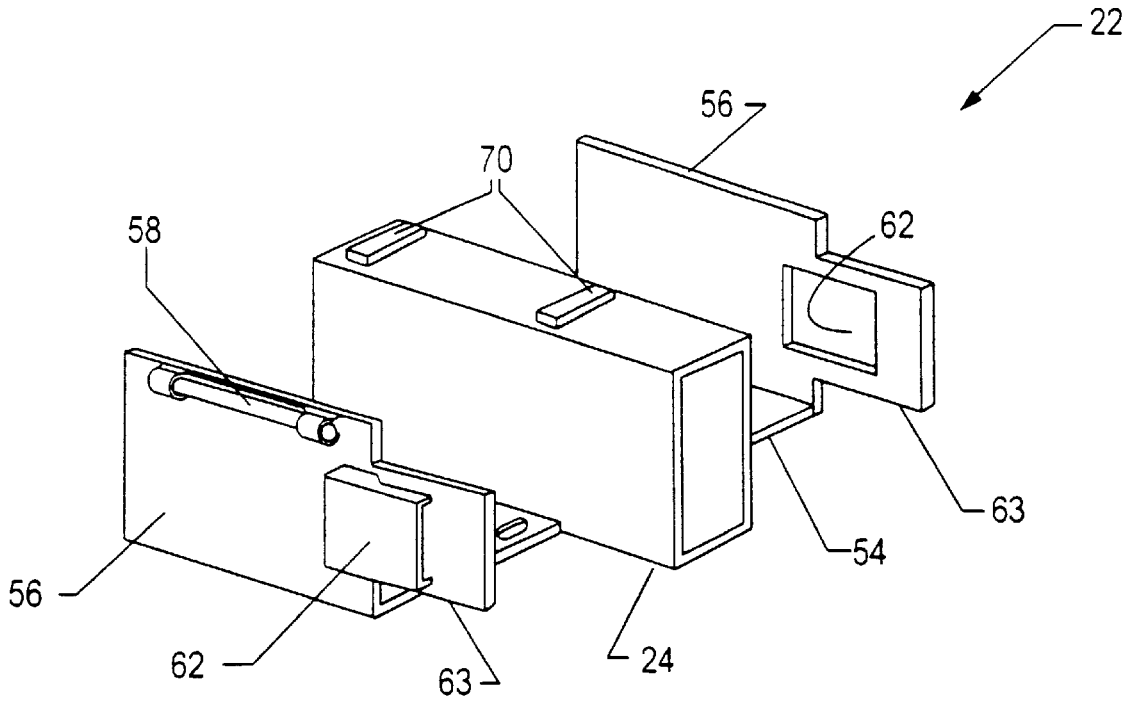
FIG. 4*a* is a perspective view illustrating the combination of the receptacle shell and receptacle spacer of the modular connector of FIG. 1.
Figure 4B:
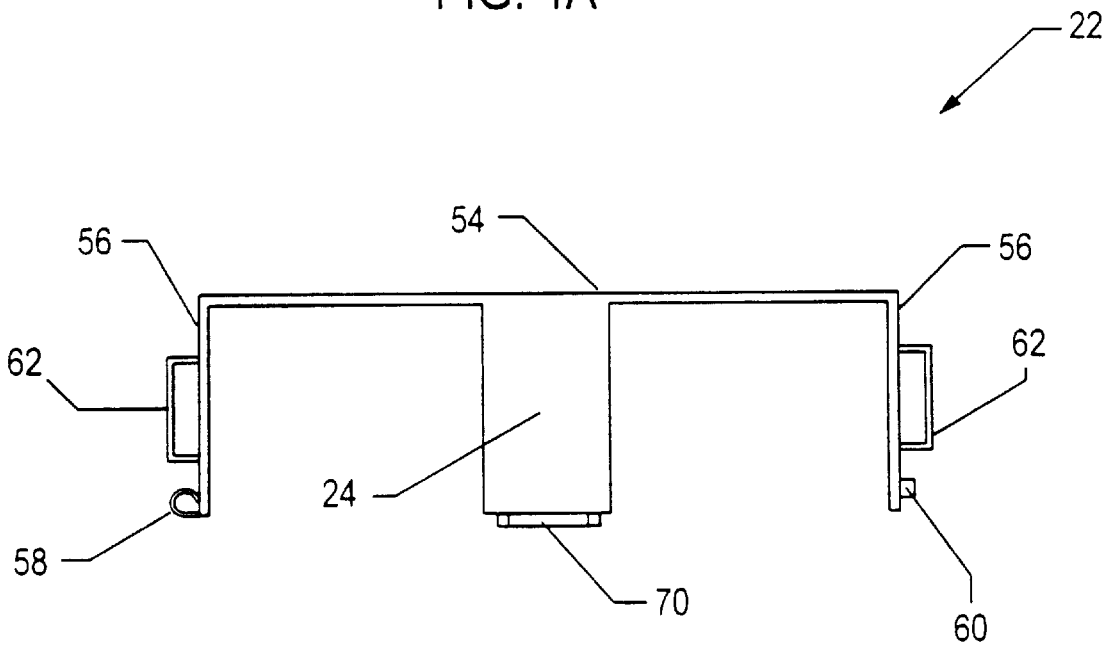
FIG. 4*b* is a bottom plan view of the combination of FIG. 4*a*.

FIGS. 4*a* and 4*b* show the receptacle shell 22 combined with the receptacle spacer 24, which is desirably a hollow member. The back side of the receptacle spacer 24 is connected to the interior surface of the back panel 54 by means such as adhesives or welding. Alternatively, the receptacle spacer 24 may be integrally formed together with the receptacle shell 22. The receptacle spacer 24 extends past the front edge of the back panel 54 of the receptacle shell 22 and, when assembled, extends about half-way through inside the grounding shell 20 between the pairs of grounding sections 46. The front side of the receptacle spacer 24 desirably has at least one protrusion, more desirably two protrusions 70 of a thickness similar to the thickness of the receptacle door 30*a* and spaced from each other.

The receptacle shell 22 and receptacle spacer 24 are desirably made of a strong, light-weight, and benign material that is not susceptible to environmental effects such as corrosion. Examples of such materials include stainless steel, desirably of the passivated 300 series type, and certain kinds of aluminum, brass, and copper.

C. Plug Member and Spacer

Figure 5A:
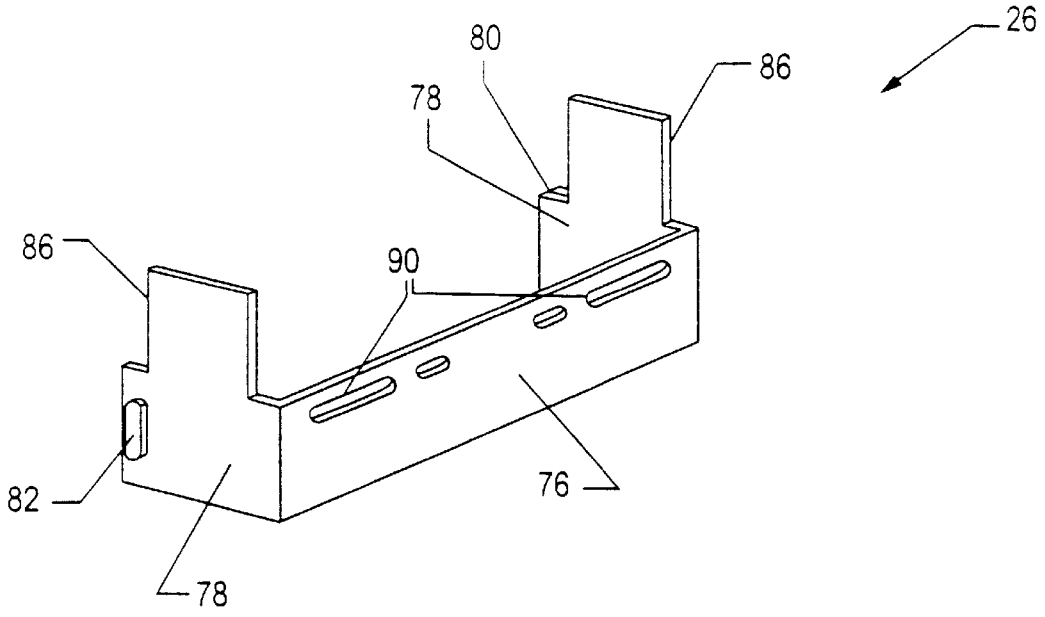
FIG. 5*a* is a perspective view illustrating the plug shell of the modular connector of FIG. 1.
Figure 5B:
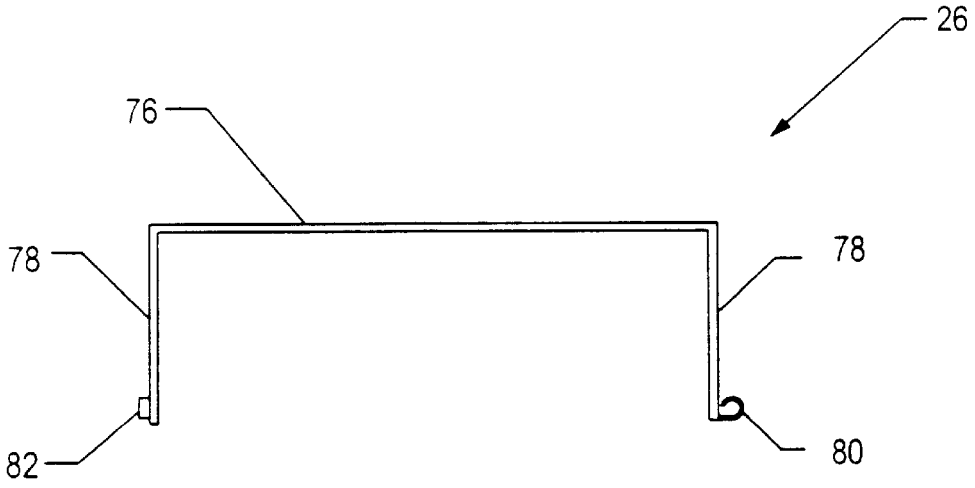
FIG. 5*b* is a bottom plan view of the plug shell of FIG. 5*a*.

The plug member or shell 26 shown in FIGS. 5*a* and 5*b* is a shell-like structure with a back panel 76 and two side panels 78. A hinge 80 is provided adjacent the open edge of one of the side panels 78 and a catch 82 extends adjacent the open edge of the other side panel 78 for installation of the plug door 30*b* of FIG. 1. When the plug door 30*b* is installed, the plug shell 26 defines a hollow region that is similar in cross-section to those of the grounding shell 20 and the receptacle shell 22. Each side panel 78 desirably has a narrower elongated section 86 extending toward the grounding member 20.

As seen in FIG. 5*a*, the back panel 76 includes a series of slots 90 near its front edge pointing toward the grounding member 20. The slots 90 are coding or characterization slots 90 which determine the selection of the modular inserts 16 to be used for particular coded locations. Different arrangements of coding slots 90 may be used depending on the specific application and characterization scheme. Advantageously, the characterization slots 90 of the plug shell 26 shown in FIG. 5*a* are mirror images of the characterization slots 66 of the receptacle shell 22 of FIG. 3*a*.

Figure 6A:
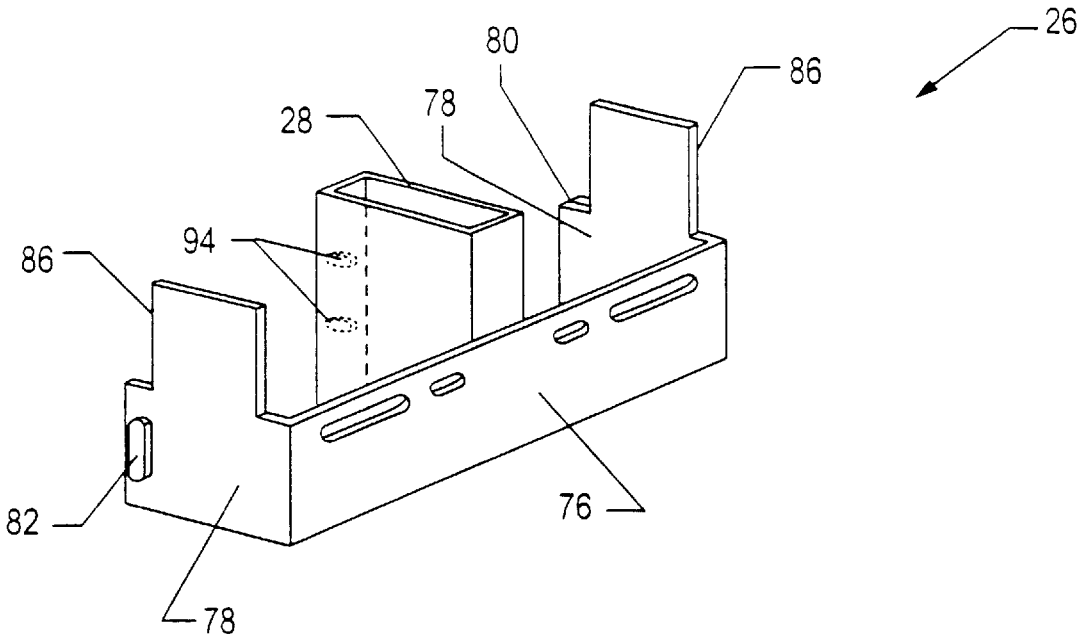
FIG. 6*a* is a perspective view illustrating the combination of the plug shell and plug spacer of the modular connector of FIG. 1.
Figure 6B:
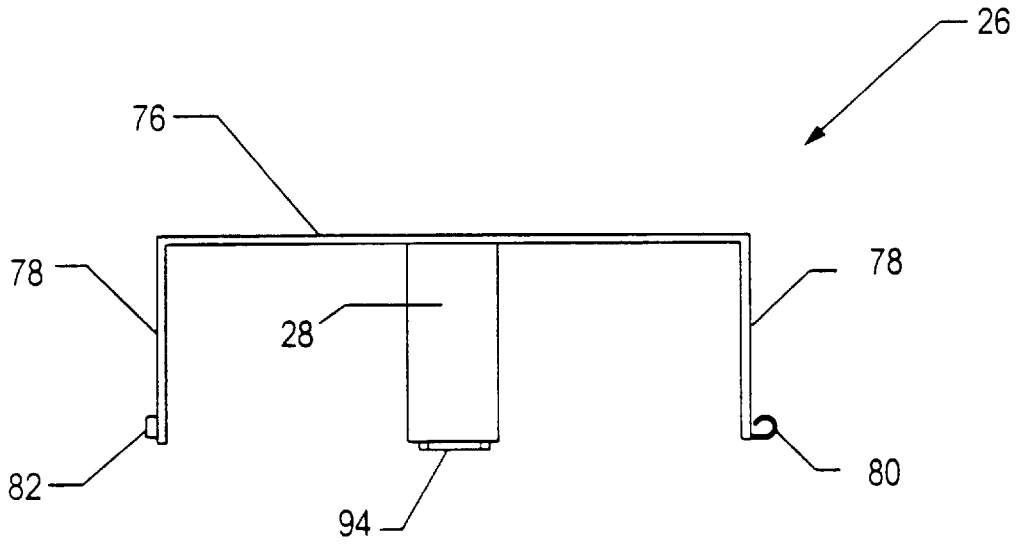
FIG. 6*b* is a bottom plan view of the combination of FIG. 6*a*.

FIGS. 6*a* and 6*b* show the plug shell 26 combined with the plug spacer 28, which is desirably a hollow member. The back side of the plug spacer 28 is connected to the interior surface of the back panel 76 by means such as adhesives or welding. Alternatively, the plug spacer 28 may be integrally formed together with the plug shell 26. The plug spacer 28 extends past the front edge of the back panel 76 of the plug shell 26 and, when assembled, extends about half-way through inside the grounding shell 20 between the pairs of grounding sections 46 and bears against the receptacle spacer 24. The front side of the plug spacer 28 desirably has at least one protrusion, more desirably two protrusions 94 of a thickness similar to the thickness of the plug door 30*b* and spaced from each other.

The plug shell 26 and plug spacer 28 are desirably made of a strong, light-weight, and benign material that is not susceptible to environmental effects such as corrosion. Examples of such materials include stainless steel, desirably of the passivated 300 series type, and certain kinds of aluminum, brass, and copper.

D. Receptacle Door and Plug Door

Figure 7:
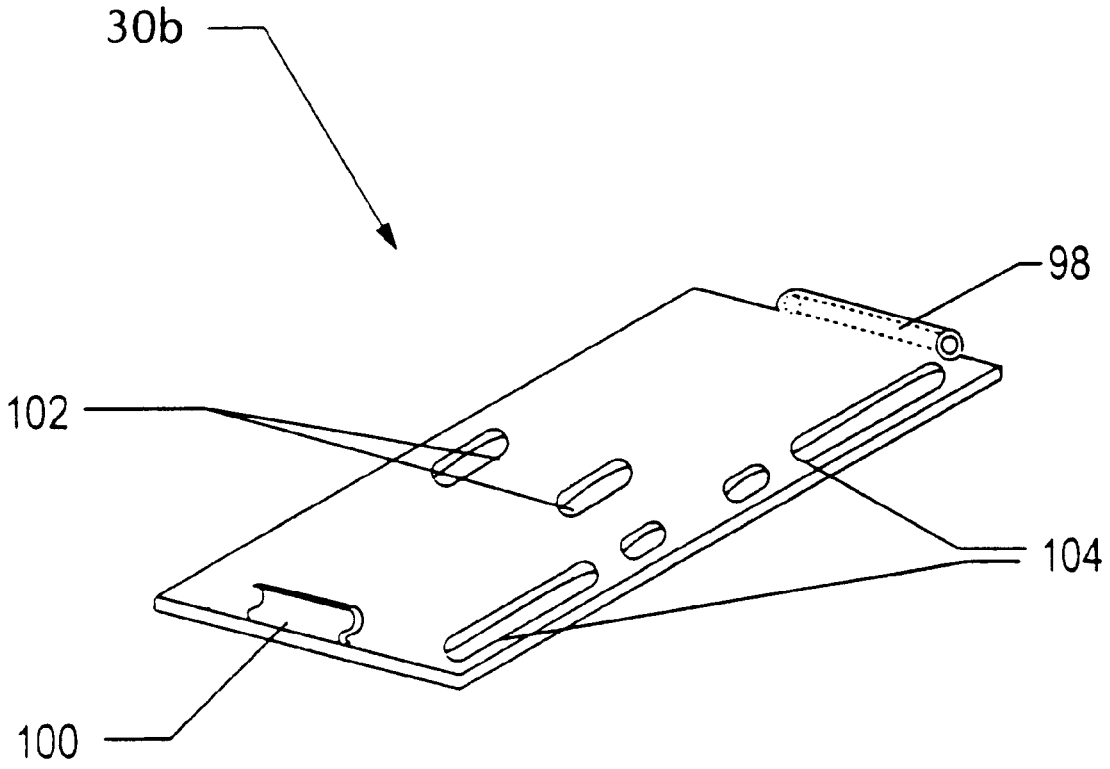
FIG. 7 is an perspective view of the door of FIG. 1.

The receptacle door 30*a* and plug door 30*b* may be different but may be generally the same. The receptacle door 30*a* as shown in FIG. 1 is slightly larger in width than the plug door 30*b* for this embodiment. FIG. 7 shows a door 30 which may be used as the receptacle door 30*a* or the plug door 30*b* in this embodiment, except for the difference in width. The following discussion will apply to both the receptacle door 30*a* and the plug door 30*b*, setting aside the difference in width between the two.

The door 30*a* or 30*b* is sized to fit between the side panels 56 of the receptacle shell 22 or the side panels 78 of the plug shell 26, respectively. With reference to a plug door 30*b*, the door 30*b* includes a hinge member 98 near an edge which is configured to cooperate with the hinge 80 of the plug shell 26. Adjacent the opposite edge is a hitch member 100 which is configured to engage the catch 82 of the plug shell 26 to secure the door 30*b* in the closed position. In the embodiment shown in FIG. 7, the hitch member 100 is a curved plate which can snap easily onto the catch 82. A similar description applies to receptacle door 30*a*.

The door 30 desirably includes at least one opening 102, more desirably two openings 102 which are aligned with the protrusions 70 of the receptacle spacer 24 or the protrusions 94 of the plug spacer 28. The openings 102 cooperate with the protrusions 70, 94 when the door 30 is assembled and closed to secure the door 30 against movement in any direction along the plane defined by the door 30. When assembled, the protrusions 70, 94 desirably are flushed with the exterior surface of the door 30 and do not protrude beyond the door 30.

The door 30 further includes a series of coding or characterization slots 104 near one edge. These coding slots 104 are advantageously mirror images of the coding slots 66 at the back panel 54 of receptacle shell 22 or the coding slots 90 at the back panel 76 of the plug shell 26 disposed opposite from and generally parallel to the door 30. However, it is only necessary to code one side of each insert 16, and thus, either the door slot 104 or shell slot 66, 90, to ensure that the insert 16 fits only into its desired location.

The door 30 is desirably made of a strong, light-weight, and benign material that is not susceptible to environmental effects such as corrosion. Examples of such materials include stainless steel, desirably of the passivated 300 series type, and certain kinds of aluminum, brass, and copper.

E. Modular Inserts

FIGS. 8*a*–8*f* illustrate a number of modular inserts 16 that may be used in the connector 10 of FIG. 1. Although the figures show generally rectangular modular inserts 16, other shapes can be used if the configuration of the body 12 of the connector 10 is likewise modified.

Figure 8A:
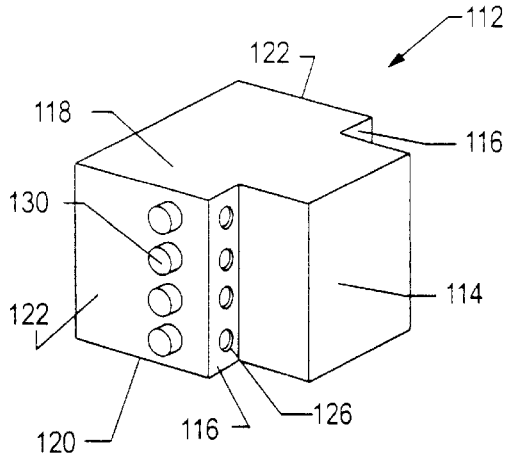
FIG. 8*a* is a perspective view of a blank modular insert.
Figure 8D:
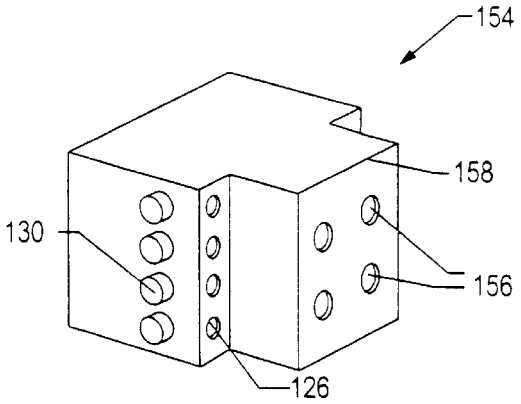
FIG. 8*d* is a perspective view of a modular insert for size 16 contact.

FIG. 8*a* shows a blank module 112 which does not have a mating portion to provide electrical connection. The blank module 112 may be used for an inactive connection that may be activated by replacing it with an active module when needed. The blank module 112 employed for the connector 10 is generally T-shaped, but may be configured differently for a different body 12.

The blank module 112 includes an inactive contact surface 114 at the front with no mating portion. A pair of side ledges 116 are generally parallel to the inactive contact surface 114 and set off from the surface 114 toward the back. The blank module 112 further includes T-shaped top surface 118 and bottom surface 120 and a pair of side surfaces 122. The blank module 112 is advantageously hollow with an open back to accommodate electrical wiring lines or cables and the like (not shown).

Through the side ledges 116 are desirably provided a series of apertures 126. FIG. 8*a* shows four such apertures 126 for each side ledge 116 which facilitate grounding connections, but a different embodiment may have a different number of apertures 126. The side ledges 116 are advantageously set off to allow grounding contacts (see FIG. 9*b*) to protrude through the apertures 126 without extending in front of the contact surface 114 and be grounded to the grounding shell 20 of FIG. 2.

Each of the two side surfaces 122 may have a plurality of coding or characterization projections or buttons 130. FIG. 8*a* illustrates a first set of a series of four characterization buttons 130 on one of the side surfaces 122, but different number and arrangement of such buttons 130 may be employed for a different embodiment. A second set of a series of four characterization buttons (not shown) may be disposed on the other side surface 122. The modular inserts 16 are desirably made of polymers with sufficient temperature ratings at low costs. Examples of such materials include glass-filled PBT plastic and glass-filled PEEK. The characterization buttons 130 are advantageously easily and quickly removable by using a knife or clipping device.

1. Differently Sized Modular Inserts

Five active modular inserts having various configurations of contact cavities are illustrated in FIGS. 8*b*–8*f*. These inserts are provided for illustrative purposes only, and do not limit the scope of the invention. The following description refers to standard wiring and contact sizes.

Figure 8B:
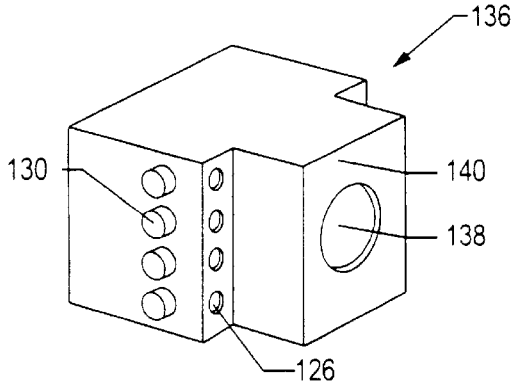
FIG. 8*b* is a perspective view of a modular insert for size 8 contact.

The active module or insert 136 shown in FIG. 8*b* differs from the blank module 112 of FIG. 8*a* only in the contact opening 138 provided on the contact surface 140. In one example, the contact opening 138 is a size 8 opening for receiving a size 8 wiring line or cable (not shown) to pass therethrough for mating contact.

Figure 8E:
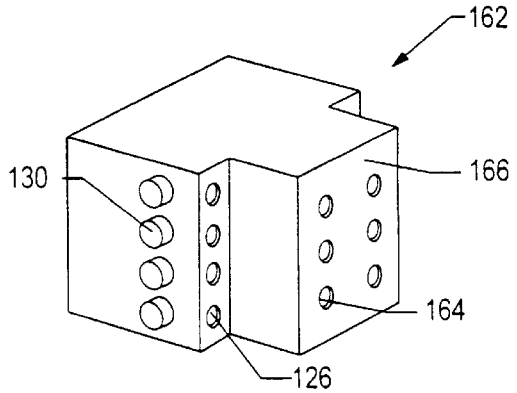
FIG. 8*e* is a perspective view of a modular insert for size 20 contact.
Figure 8C:
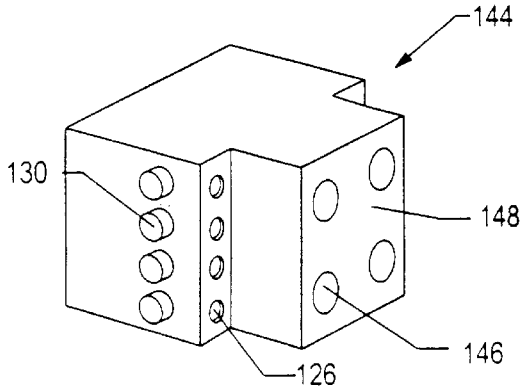
FIG. 8*c* is a perspective view of a modular insert for size 12 contact.
Figure 8F:
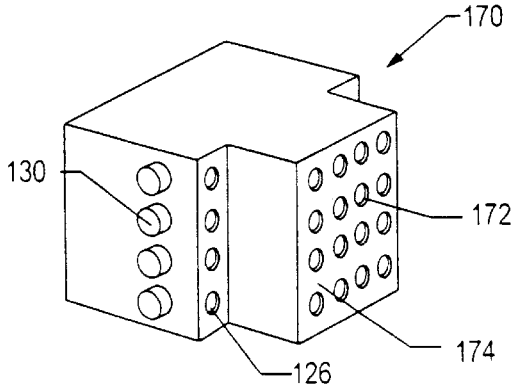
FIG. 8*f* is a perspective view of a modular insert for size 22 contact.

FIG. 8*c* shows an insert 144 with four contact openings 146 arranged over the contact surface 148 to allow four wiring lines or cables to pass therethrough to make contacts. The contact openings 146 may be size 12 openings for accommodating size 12 wiring lines or cables. The insert 154 illustrated in FIG. 8*d* also has four contact openings 156 over the contact surface 158. In the example shown, these four contact openings 156 are sized smaller than the four contact openings 146 of FIG. 8*c* to accommodate smaller wiring lines or cables. An example of such an insert 154 is size 16.

FIG. 8*e* shows an insert 162 having six contact openings 164 on the contact surface 166 to accommodate six wiring lines or cables. The insert 170 of FIG. 8*f* has even smaller contact openings 172 spread over the contact surface 174. In one example, the insert 170 has size 22 contact openings 172 that can allow sixteen size 22 wiring lines or cables to pass therethrough for mating connections. The examples shown in FIGS. 8*b*–8*f* are merely illustrative. Other inserts having different numbers of contact openings may be employed.

2. Characterization Scheme

The characterization buttons 130 of the modules shown in FIGS. 8*a*–8*f* are sized to cooperate with the characterization slots 66 of the receptacle shell 22 of FIG. 3*a*, characterization slots 90 of the plug shell 26 of FIG. 5*a*, or the characterization slots 104 of the receptacle door 30*a* or plug door 30*b* of FIG. 7. The receptacle shell 22 functions as a receptacle insert holder. Generally, an insert 16 with all four buttons 130 will not fit within the plug shell 26 or receptacle shell 22 because the characterization slots (66, 90, or 104) are not configured to receive all four buttons 130. In the coding or characterization scheme of this embodiment, one of the four characterization buttons 130 is removed. It is only necessary to remove a characterization button 130 from one side of each insert 16 to ensure that the insert 16 fits only into its desired location. In a different characterization scheme, more than one of the four characterization buttons 130 may be removed for matching the insert 16 to the plug shell 26 or receptacle shell 22, or a button 130 may be removed from both sides of the modular insert 16.

Figure 9A:
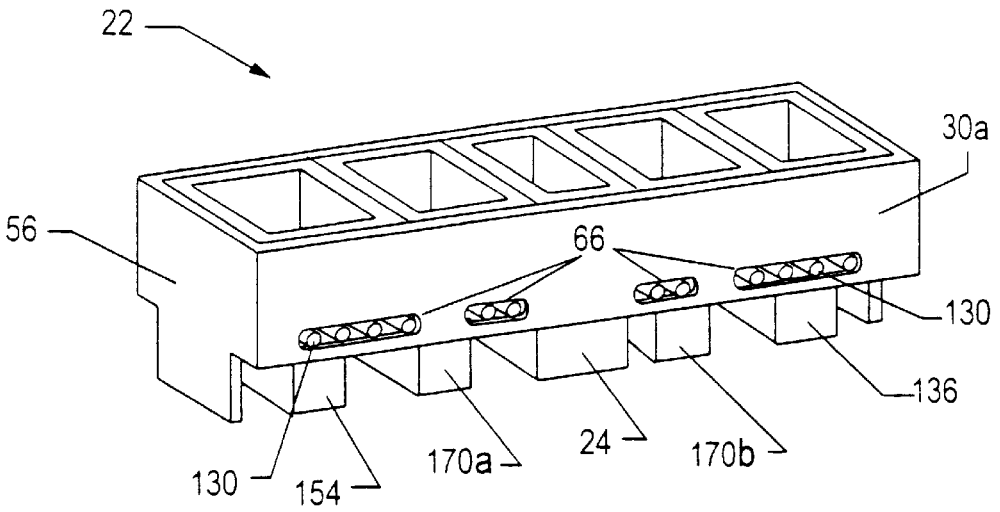
FIG. 9*a* is a perspective view of receptacle modular inserts supported in the receptacle shell and receptacle door of FIG. 1.

FIG. 9*a* shows four of the modular inserts 16 of FIG. 1 which are supported in the receptacle shell 22 with the receptacle door 30*a* installed. Grommets (not shown) may be used over the modular inserts 16 for sealing. In the example shown, the four receptacle modular inserts include one size 16 insert 154 and one size 22 insert 170*a* on the left of the receptacle spacer 24, and one size 22 insert 170*b* and one size 8 insert 136 on the right of the receptacle spacer 24. The receptacle spacer 24 separates and protects the inserts 154, 170*a* in the left lot from the inserts 170*b*, 136 in the right lot. Each of the inserts 154, 170*a*, 170*b*, 136 has four characterization buttons 130 when it is first manufactured as discussed above and shown in FIGS. 8*a*–8*f*. In FIG. 9*a*, the first button from the left of the size 16 insert 154 is removed, the second button from the left of the size 22 insert 170*a* is removed, the third button from the left of the size 22 insert 170*b* is removed, and the fourth button from the left of the size 8 insert 136 is removed. The remaining characterization buttons 130 of the modular inserts 154, 170*a*, 170*b*, 136 extend through the characterization slots 104 of the receptacle door 30*a* and are desirably flushed with the exterior surface of the characterization door 30*a*. The removal of the appropriate button 130 allows the modular inserts 154, 170*a*, 170*b*, 136 to be inserted into their respective coded positions as determined by the configuration of the characterization slots 104 of the receptacle door 30*a*. For instance, the size 8 insert 136 cannot trade places with the size 22 insert 170*a* because the characterization buttons 130 will not fit with the characterization slots 104. As a result, errors in the installation of the mating contact for the connector 10 are minimized or eliminated.

Referring to FIG. 9*a*, at the rear of the modular inserts 154, 170*a*, 170*b*, 136 may also have a set of characterization buttons 130 (not shown) which are mirror images of those at the front as shown. Those buttons 130 cooperate with the characterization slots 66 of the receptacle shell 22 in a manner similar to the cooperation of the front buttons 130 with the characterization slots 104 of the receptacle door 30*a*.

As shown in FIG. 1, there are four modular inserts 16 supported by the plug shell 26 opposite from the four receptacle inserts 16. In the example, the four plug modular inserts 16 have generally the same configuration of contact cavities as the receptacle modular inserts 154, 170*a*, 170*b*, 136, but turned upside down, for mating. These plug inserts 154', 170*a'*, 170*b'*, 136' (not shown) are supported by the characterization slots 90 of the plug shell 26 at the back and the characterization slots 104 of the plug door 30*b* at the front in a manner similar to the support of the receptacle inserts 154, 170*a*, 170*b*, 136 in the receptacle shell 22 with receptacle door 30*a*. The plug inserts 154', 170*a'*, 170*b'*, 136' thus also have similar characterization slots 130, and are indeed identical to the receptacle inserts 154, 170*a*, 170*b*, 136, but inverted with respect thereto (see FIG. 1). The plug shell 26 functions as a plug insert holder. The plug spacer 28 separates and protects the plug inserts 154', 170*a* ' in the left lot from the plug inserts 170*b'*, 136' in the right lot.

The modular configuration of the connector 10 employing the modular inserts 16 facilitates a great deal of possible variations in configuring the connector 10 to suit different needs. For each size insert (136, 144, 154, 162, 170), only one type of insert needs to be made and stocked, namely, the ones with four characterization buttons 130 (see FIGS. 8*b*–8*f*). By removing one of the characterization buttons 130, the one type of insert (136, 144, 154, 162, 170) can be adaptable to different locations, making the connector 10 robustly adaptable to a wide range of applications. The blank module 112 can also be used when appropriate to deactivate a contact. Variation of this coding or characterization scheme can be developed by those with ordinary skill in the art without undue experimentation. Other coding or characterization schemes can be derived based on that disclosed herein and are considered to fall within the scope of the invention.

3. Assembly of Modular Inserts

Figure 9B:
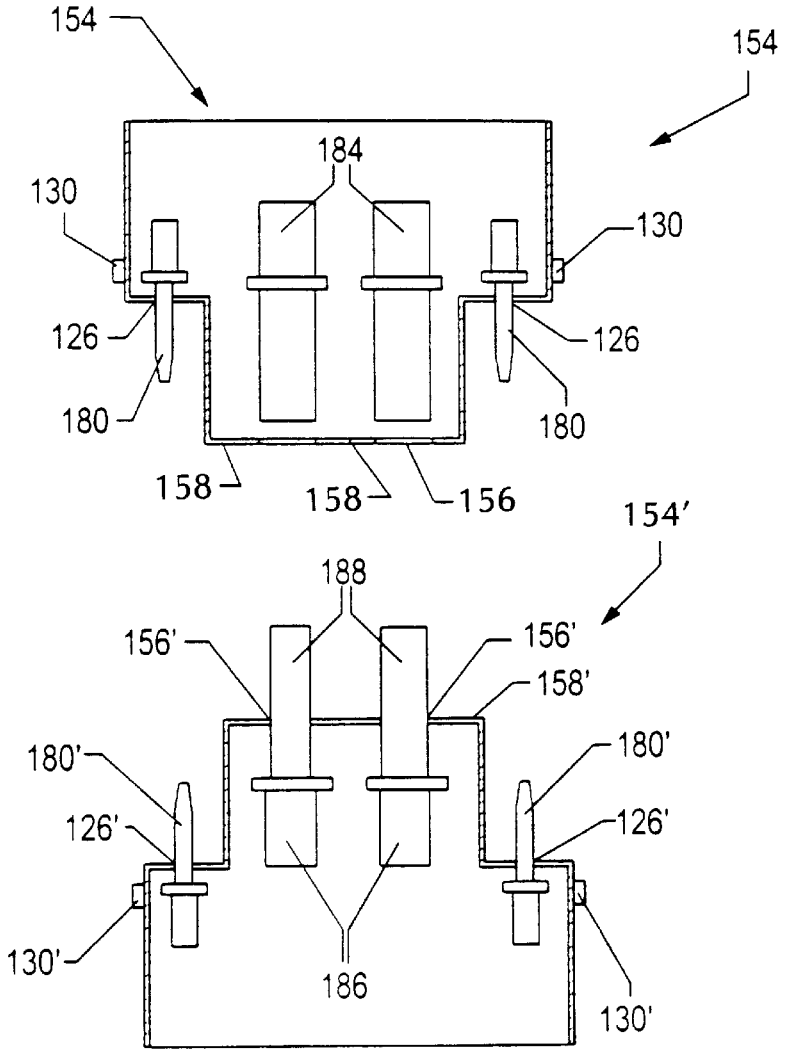
FIG. 9*b* is a exploded partial cross-sectional view illustrating a receptacle modular insert and a plug modular insert configured for mating.

When assembled, the plug inserts 154', 170*a*', 170*b*', 136' slide against the receptacle inserts 154, 170*a*, 170*b*, 136 at an interface. An exploded view of one of the pair of inserts, plug insert 154' and receptacle insert 154, is illustrated in FIG. 9*b*. The contact surface 158' of the plug insert 154' faces the contact surface 158 of the receptacle insert 154, and they slide against one another when assembled. The same holds for the other contact surfaces of the three other pairs of inserts: 174*a* and 174*a*' for inserts 170*a* and 170*a*'; 174*b* and 174*b*' for inserts 170*b* and 170*b*'; 140 and 140' for inserts 136 and 136' (not shown).

FIG. 9*b* shows a pair of grounding contacts 180, 180' supported partially inside each insert 154, 154' and protruding from the apertures 126, 126' of each of the inserts 154, 154'. Because each insert 154, 154' has four pairs of apertures 126, 126' (see FIG. 8*d*), there can be as many as four pairs of grounding contacts 180, 180' supported by the apertures 126, 126' for each insert 154, 154'. When assembled, these grounding contacts 180, 180' come in contact with the grounding apertures 48 of the grounding sections 46 of the grounding shell 20 for grounding (see FIG. 2). The contact surface 158 of the receptacle insert 154 (as well as the contact surfaces 174*a*, 174*b*, 140 of the other receptacle inserts 170*a*, 170*b*, 136) is disposed inside the grounding shell 20 (not shown). The contact surface 158' of the plug insert 154' (as well as the contact surfaces 174*a*', 174*b*', 140' of the other receptacle inserts 170*a*', 170*b*', 136') is disposed inside the grounding shell 20 (not shown).

For ease of reference, the characterization buttons 130 on the receptacle insert 154 are referred to as receptacle characterization buttons, while the characterization buttons 130 on the plug insert 154' are referred to as plug characterization buttons. However, these inserts are interchangeable.

Referring to FIG. 9*b*, the receptacle insert 154 also supports four receptacle signal or power contacts 184, which are female contacts, (only two shown) inside the receptacle insert 154. The female contacts 184 each includes a cavity that opens up toward the contact surface 158 of the receptacle insert 154 and spaced from the contact openings 156. The plug insert 154' supports four plug signal or power contacts 186, which are male contacts, (only two shown) inside the plug insert 154' with the front ends 188 protruding through the contact openings 156' of the contact surface 158'. The front ends 188 of the male contacts 186 are sized to penetrate the contact openings 156' of the plug insert 154'. When assembled, the front ends 188 of the male contacts 186 penetrate through the contact openings 156 of the receptacle insert 154 into the cavities of the corresponding female contacts 184, which are desirably sized to receive the front ends 188 of the male contacts 186 in slip fit contact.

The male contacts 186 may be supported in the plug insert 154' and the female contacts 184 in the receptacle insert 154 by any appropriate means known to those with skill in the art. In one embodiment, the male and female contacts 186, 184 are supported and retained respectively by contact retention clips (not shown), the details of which are well known in the art and not discussed here. The contacts 186, 184 and the grounding contacts 180, 180' are advantageously assembled with the corresponding modular inserts 16 (including 154, 154') at the subassembly level to expedite the connection process at the structure or vehicle assembly level. At that time, the wiring lines or cables (not shown) can simply be coupled to the appropriate contacts 186, 184 and grounding contacts 180, 180' for connection and no additional assembly of the modular inserts 16 is needed.

The female signal contacts 184 shown in FIG. 9*b* form a socket insert block, while the male signal contacts 186 form a pin insert block. Although FIG. 9*b* shows the receptacle insert 154 as the socket insert block with the female signal contacts 184 and the plug insert 154' as the pin insert block with the male signal contacts 186, the two types of blocks can be reversed. In another embodiment, therefore, the receptacle insert 154 may be a pin insert block and the plug insert 154' a socket insert block. The receptacle shell 22 and plug shell 26 are desirably sized to receive either the socket insert block or the pin insert block. The connector 10 becomes more versatile. In one embodiment, the pin insert block is shorter in length than the socket insert block to account for the protruding front end 188 of the male signal contacts 186.

F. Connector Assembly

Figure 10B:
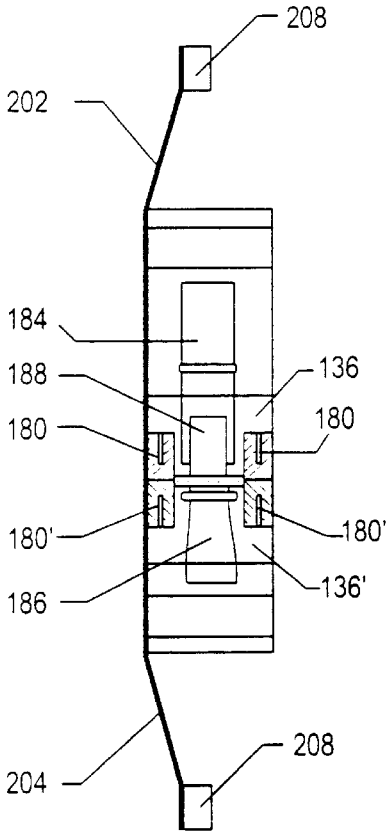
FIG. 10*b* is a side partial cross-sectional view of the modular connector of FIG. 10*a* along line A—A illustrating mating of the modular inserts.
Figure 10A:
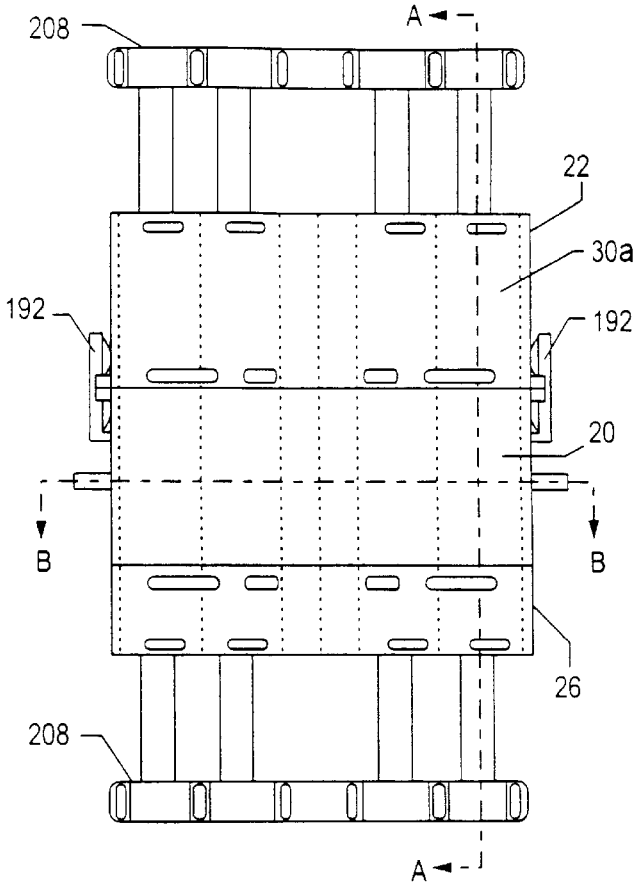
FIG. 10*a* is a front elevational view of the assembled modular connector of FIG. 1.
Figure 10C:
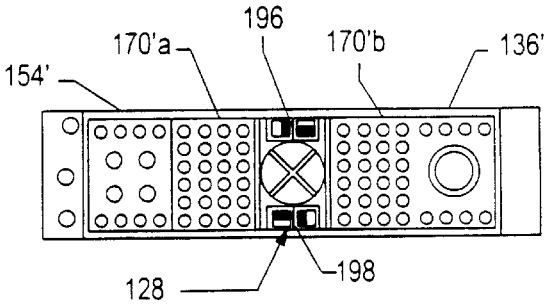
FIG. 10*c* is a plan partial cross-sectional view of the modular connector of FIG. 10*a* along line B—B illustrating the mating face of the modular inserts.

Referring to the assembled connector 10 of FIGS. 10*a*–10*c*, the receptacle shell 22 with the receptacle door 30*a* installed is disposed above the grounding shell 20, which is affixed and grounded to the structure or vehicle. Advantageously, retention clips 192 are used to secure the receptacle shell 22 to the grounding shell 20 to prevent separation of the two during the connection process. The four receptacle inserts 154, 170*a*, 170*b*, 136 are supported inside the receptacle shell 22 in the manner shown in FIG. 9*a*, with their grounding contacts 180 inserted through the grounding apertures 48 of the grounding sections 46 of the grounding shell 20, as best seen in FIG. 10*b*. The contact surfaces 158, 174*a*, 174*b*, 140 (not shown) are disposed inside the grounding shell 20.

The plug shell 26 with the plug door 30*b* installed is disposed below the grounding shell 20. The four plug inserts 154', 170*a*', 170*b*', 136' are supported inside the plug shell 26 as discussed above for FIG. 9*a*, with their grounding contacts 180' inserted through the grounding apertures 48 of the grounding sections 46 of the grounding shell 20, as best seen in FIG. 10*b*. The contact surfaces 158', 174*a*', 174*b*', 140', as best seen in FIG. 10*c*, are disposed inside the grounding shell 20 and slide against the contact surfaces 158, 174*a*, 174*b*, 140 of the corresponding receptacle inserts 154, 170*a*, 170*b*, 136 as discussed above in connection with FIG. 9*b*. The front ends 188 of the male contacts 186 of the plug inserts 154', 170*a*', 170*b*', 136' penetrate into the cavities of the female contacts 184 of the receptacle inserts 154, 170*a*, 170*b*, 136 in the manner discussed and shown in FIG. 9*b* to achieve electrical connection for conveying signals or power. FIG. 10*b* shows another such connection for the pair of inserts 136, 136'. Advantageously, the grounding shell 20 not only provides a grounding function, but also aligns the receptacle shell 22 with the plug shell 26 and the corresponding components supported therein.

The plug shell 26 is desirably secured to the receptacle shell 22 by a quick and easy method. An example of such a method is the use of a 120 degree turn-to-lock coupling mechanism which is well known in the art and will not be discussed here. One embodiment of such a coupling mechanism is a bayonet coupling mechanism 196 shown in part in FIG. 10*c*, which takes a single, even force, 120 degree turn to lock. The coupling mechanism 196 is conveniently disposed through the hollow plug spacer 28 and receptacle spacer 24 for operation. The coupling mechanism 196 desirably includes a combination locking key 198 with a high number of keying combinations, the operation of which is known in the art.

FIGS. 10*a* and 10*b* show the receptacle wiring lines or cables 202 extending out of the receptacle inserts (154, 170*a*, 170*b*, 136) through the receptacle shell 22 and plug wiring lines or cables 204 extending out of the plug inserts (154', 170*a*', 170*b*', 136') through the plug shell 26. Strain reliefs 208 or similar devices are desirably provided to secure the wiring lines 202, 204 and prevent loading applied through the wiring lines 202, 204 to the inserts (154, 170*a*, 170*b*, 136, 154', 170*a*', 170*b*', 136'). Details of strain reliefs 208 are known in the art and not discussed here.

1. Grounding Scheme

A low resistance grounding scheme is advantageously achieved by the use of the T-shaped modular inserts 16 (154, 154') incorporating the grounding contacts 180, 180' shown in FIG. 9*b*, which minimizes or eliminates multiple intermediate grounding contacts. To achieve grounding, the insulation or shields on the wiring lines or cables 202, 204 are stripped and grounding wires (not shown) are used to ground the shields to the structure or vehicle via crimped contacts on the grounding contacts 180, 180', which in turn are grounded to the grounding shell 20 as shown in FIG. 10*b*. This scheme yields a substantially lower resistance to ground of any grounding scheme provided by removable contact connector currently available.

2. Assembly Procedure

To assemble the connector 10 of FIGS. 10*a*–10*c*, the receptacle wiring lines 202 and plug wiring lines 204 are stripped and grounding wires (not shown) are used to ground the shields to the structure or vehicle via crimped contacts on the grounding contacts 180, 180' of the modular inserts (154, 170*a*, 170*b*, 136, 154', 170*a*', 170*b*', 136'). The receptacle wiring lines 202 are coupled to the appropriate receptacle female contacts 184 in the receptacle inserts 154, 170*a*, 170*b*, 136. The plug wiring lines 204 are coupled to the appropriate plug male contacts 186 in the plug inserts 154', 170*a*', 170*b*', 136'. The modular inserts (154, 170*a*, 170*b*, 136, 154', 170*a*', 170*b*', 136') are characterized by removing one of at least one set of four characterization buttons 130 on each of the modular inserts. The receptacle inserts 154, 170*a*, 170*b*, 136 are loaded onto the receptacle shell 22 with the rear characterization buttons 130 cooperating with the characterization slots 66. The receptacle door 30*a* is closed to place the characterization slots 104 of the receptacle door 30*a* in cooperation with the front characterization buttons 130. The plug inserts 154', 170*a*', 170*b*', 136' are loaded onto the plug shell 26 with the rear characterization buttons 130 cooperating with the characterization slots 90. The plug door 30*b* is closed to place the characterization slots 104 of the plug door 30*b* in cooperation with the front characterization buttons 130. The wiring lines 202, 204 are secured to the strain reliefs 208 for protection.

The receptacle shell 22 is joined with the grounding shell 20 which is supported by the structure or vehicle, and retained with the retention clips 192. The plug shell 26 is placed on the other side of the grounding shell 20 and secured to the receptacle shell 22 using the Bayonet coupling mechanism 196. Advantageously, the retainer clip 192 secures the receptacle shell 22 to the grounding shell 20 and prevents them from separating when a pushing force applied from the plug shell 26 toward the receptacle shell 22 is used to lock the Bayonet coupling mechanism 196. As a result, the receptacle inserts 154, 170*a*, 170*b*, 136 are mated with the plug inserts 154', 170*a*', 170*b*', 136' to convey signals or power. The grounding contacts 180 of the receptacle inserts 154, 170*a*, 170*b*, 136 and the grounding contacts 180' of the plug inserts 154', 170*a*', 170*b*', 136' are coupled to the grounding apertures 48 of the grounding sections 46 of the grounding shell 20 for grounding. Advantageously, the connector 10 can be assembled easily and quickly without the need for tools.

In some cases, the plug shell 26 is not installed but the receptacle shell 22 with its components are installed in the vehicle or other structure to provide electrical connection halves ready for mating when desired. Conductive caps (not shown) are desirably available for sealing unused plug or receptacle inserts 16 as well as providing electrostatic protection. Plastic dust caps (not shown) may be provided for contact protection of the modular inserts 16 at the harness assembly and routing levels.

The modularity of the connector 10 makes it robust and adaptable to different applications. The number of different component parts that must be manufactured and maintained in inventory is reduced. A low resistance grounding scheme is achieved. The connector 10 is easy and efficient to assemble and use.

It will be understood that the above-described arrangements of apparatus and the methods therefrom are merely illustrative of applications of the principles of this invention and many other embodiments and modifications may be made without departing from the spirit and scope of the invention as defined in the claims.

What is claimed is:

1. A modular connector for conveying signals or power, said connector comprising:

a receptacle insert holder having at least one first preset receptacle characterization slot;

at least one receptacle insert having a first set of first removable receptacle characterization buttons, wherein the number or location or both number and location of said first removable receptacle characterization buttons is adjusted so that said receptacle insert is insertable through a portion of said at least one first preset receptacle characterization slot, for support of said receptacle insert in said receptacle insert holder in a preset location within said connector;

a plug insert holder having at least one first preset plug characterization slot; and at least one plug insert having a first set of first removable plug characterization buttons, wherein the number or location or both number and location of said first removable plug characterization buttons is adjusted so that said plug insert is insertable through a portion of said at least one first preset plug characterization slot, for support of said plug insert in said plug insert holder in a preset location within said connector.

2. The connector of claim 1, wherein said receptacle insert holder comprises a back panel with said at least one first receptacle characterization slot and a door panel spaced from said back panel, and said at least one receptacle insert is supported between said back panel and said door panel.

3. The connector of claim 1, wherein said at least one receptacle insert or said at least one plug insert comprises at least one grounding contact.

4. The connector of claim 2, wherein said door panel comprises at least another, second preset receptacle characterization slot and said at least one receptacle insert comprises a second set of removable receptacle characterization buttons, wherein with removal of at least one of said second removable receptacle characterization buttons, said second set of removable receptacle characterization buttons is insertable through at least a portion of said second preset receptacle characterization slot at a second preset location within said connector.

5. The connector of claim 2, wherein said door panel is movable relative to said back panel.

6. The connector of claim 3, farther comprising a grounding member which includes at least one grounding section having at least one aperture comprising a grounding contact for receiving said at least one receptacle insert grounding contact or said at least one plus insert grounding contact.

7. The connector of claim 4, wherein said second receptacle characterization slot is a mirror image of at least one other receptacle characterization slot.

8. The connector of claim 6, wherein said receptacle insert holder is fastenable to said grounding member and said plug insert holder is attachable to said receptacle insert holder to form an assembly in which a contact of said at least one plug insert is in slip contact with a contact of said at least one receptacle insert.

9. The connector of claim 8, wherein said plug insert holder is attached to said receptacle insert holder by a bayonet coupling mechanism extending through a hollow plug spacer connected to said plug insert holder and a hollow receptacle spacer connected to said receptacle insert holder.

10. A device for forming an electrical connection, said device comprising:

at least one pair of mating inserts, each said pair of mating inserts including a receptacle insert and a plug insert, said receptacle insert having a plurality of removable receptacle coding buttons and at least one receptacle contact, said plug insert having a plurality of removable plug coding buttons and at least one plug contact engageable with said at least one receptacle contact for mating contact, said at least one receptacle contact and said at least one plug contact being equal in number; and a body comprising at least one member for supporting said at least one pair of mating inserts, wherein said body includes at least one opening into which remaining coded buttons fit, whereby said pair of mating inserts fit in mating contact in coded positions at particular locations within said body.

11. The device of claim 10, wherein said at least one opening which accommodates said plurality of removable receptacle coding buttons with at least one of said removable receptacle coding button removed from said receptacle insert, and at least one opening which accommodates said plurality of removable plug coding buttons with at least one said removable plug coding button removed from said plug insert.

12. The device of claim 10, wherein said receptacle insert and said plug insert are generally similar in shape and having respectively generally rectangular contact surfaces opposite to one another and sliding against one another when said at least one plug contact is in contact with said at least one receptacle contact.

13. The device of claim 11, wherein said body comprises a plurality of openings for supporting receptacle inserts in different coded positions, and a plurality of openings for supporting plug inserts in different coded positions.

14. The device of claim 11, wherein said body comprises a receptacle shell and a plug shell, said receptacle shell including at least one receptacle coding slot, and said plug shell including at least one plug coding slot, said plug shell being movable relative to said receptacle shells between a closed position where said receptacle insert and said plug insert of said at least one pair of mating inserts are in mating contact and an open position where said plug insert is spaced from said receptacle insert.

15. The device of claim 14, wherein said receptacle shell comprises a back panel, two side panels connected to said back panel, and a front door connected to at least one of said two side panels and movable relative to said back panel and side panels, a receptacle spacer disposed between said back panel and front door and spaced from said side panels to define a left lot to the left of said receptacle spacer and a right lot to the right of said receptacle spacer, said left lot capable of housing at least one of said receptacle inserts, and said right lot capable of housing at least one of said receptacle inserts.

16. The device of claim 14, wherein said plug shell comprises a back panel, two side panels connected to said back panel, and a front door connected to at least one of said two side panels and movable relative to said back panel and side panels, a plug spacer disposed between said back panel and front door and spaced from said side panels to define a left lot to the left of said plug spacer and a right lot to the right of said plug spacer, said left lot capable of housing at least one of said plug inserts, and said right lot capable of housing at least one of said plug inserts.

17. A modular insert for forming mating contact in a modular connector structure having a plurality of preset insert locations, said modular insert comprising a contact surface having zero or at least one contact opening and a plurality of removable characterization buttons, wherein by removing at least one of said plurality of removable characterization buttons, said modular insert becomes receivable in only one of said plurality of preset insert locations of said structure.

18. The modular insert of claim 17, wherein said plurality of removable characterization buttons are disposed over at least one surface that is generally perpendicular to said contact surface.

19. The modular insert of claim 17, further comprising at least one aperture for supporting at least one grounding contact.

20. The modular insert of claim 17, wherein said insert is a block having a T-shaped cross-section and said plurality of removable characterization buttons are disposed on at least one surface of said block.

21. The modular insert of claim 17, further comprising at least one contact disposed at least partially in said modular insert, said at least one contact being equal in number and approximately equal in shape and size to said at least one contact opening.

22. The modular insert of claim 19, wherein said at least one aperture is set off in a rear direction from said contact surface for supporting said at least one grounding contact.

23. The modular insert of claim 21, wherein said at least one contact is a contact disposed in said modular insert, which contact includes a cavity with an opening facing and spaced from said at least one contact opening of said contact surface.

24. The modular insert of claim 21, wherein said at least one contact is a contact disposed partially in said modular insert, which contact includes a front end which penetrates through said at least one contact opening and protrudes from said contact surface.

25. An adaptable insert for forming mating contact in a modular connector structure, said adaptable insert comprising a contact surface having zero or at least one contact opening and at least one aperture for supporting at least one grounding contact, said at least one aperture being set off in a rear direction from said insert contact surface, to support said at least one grounding contact for grounding said insert to said modular connector structure.

26. The adaptable insert of claim 25, wherein said at least one aperture is disposed on at least one side ledge of said insert, and is set off in a rear direction from said insert contact surface.

27. The adaptable insert of claim 26, wherein said insert is a block having a T-shaped cross-section.

28. The adaptable insert of claim 27, further comprising a plurality of removable characterization buttons on at least one side surface of said block, wherein, by removing at least one of said plurality of removable characterization buttons, said adaptable insert becomes insertable into only one of a plurality of preset insert locations of said modular connector structure.

* * * * *